US005988272A

United States Patent [19]

Bruce

[11] Patent Number: 5,988,272

[45] Date of Patent: Nov. 23, 1999

[54] APPARATUS AND METHOD FOR MILLING A WELL CASING

[76] Inventor: Ronald James Bruce, Morven View, Lumphanan, Aberdeen, AB31 4QB, United Kingdom

[21] Appl. No.: 09/051,209

[22] PCT Filed: Oct. 7, 1996

[86] PCT No.: PCT/GB96/02447

§ 371 Date: Jun. 17, 1998

§ 102(e) Date: Jun. 17, 1998

[87] PCT Pub. No.: WO97/13053

PCT Pub. Date: Apr. 10, 1997

[30] Foreign Application Priority Data

Oct. 5, 1995 [GB] United Kingdom ..... 9520347

[51] Int. Cl.[6] ..... E21B 7/06

[52] U.S. Cl. ..... 166/55.6; 166/298; 175/61

[58] Field of Search ..... 166/117.6, 50, 166/117.5, 298, 55.7, 55.6; 175/61, 81

[56] References Cited

U.S. PATENT DOCUMENTS 4,059,165 11/1977 Clark ..... 175/107
4,144,936 3/1979 Evans ..... 166/298
5,431,219 7/1995 Leising et al. ..... 166/50
5,584,350 12/1996 Schnitker et al. ..... 175/61
5,860,474 1/1999 Stoltz et al. ..... 166/50

*Primary Examiner*—Frank Tsay
*Attorney, Agent, or Firm*—Watson Cole Grindle Watson, P.L.L.C.

[57] ABSTRACT

Apparatus for milling the casing of an oil or gas well comprises a downhole assembly which is run into the well on a rotatable drill string. The assembly comprises a motor (6) the body of which is connected to the drill string and the output shaft of which is connected to a casing mill (9). In use, the drill string is rotated in one rotational direction and the motor (6) is operated to rotate the output shaft thereof in the same rotational direction whereby the speed of rotation of the mill (9) is faster than the rotational speed of the drill string. Because the rotational speed of the milling tool (9) cannot be less than the rotational speed of the output shaft of the motor (6) relative to the body thereof extreme variations in the rotational speed of the milling tool due to winding up of the drill string are avoided. The downhole assembly may incorporate a taper mill (11), stabilizers (10, 8 and 5) and a jet sub (4). The assembly may also incorporate a constant thrust device for producing a substantially constant thrust loading on the milling tool and one or more cement removing tools.

10 Claims, 1 Drawing Sheet

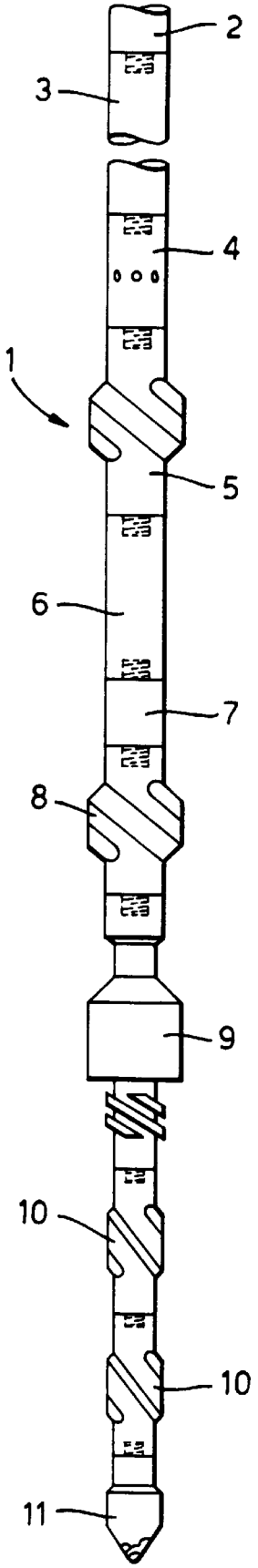
2
3
4
1
5
6
7
8
9
10
10
11

APPARATUS AND METHOD FOR MILLING A WELL CASING

BACKGROUND OF THE INVENTION

It is well known in the drilling industry, and in particular in the oil and gas drilling industry, to protect boreholes with a steel liner which is known as a "casing". From time to time, it is necessary to replace all or part of such casings. Whilst, on occasions, it may be possible to remove large sections of casing intact it is recognized that under certain circumstances casing can only be removed by milling. Milling is carried out by running a tool having appropriate milling formations into the casing on a tubing string, and rotating the string to rotate the tool and thereby mill away the material of the casing.

Typical milling tools are shown in U.S. Pat. No. 4,717,290; EP-A-231989, EP-A-266484 and EP-A-385673.

A well recognized problem which occurs during milling operations of this type is that the swarf formed by the milled casing material includes long strands which cannot easily be cleared from the milling tool by a conventional mud flushing techniques. These long strands tend to form "birdsnests" which can impair operation of the milling tool and, in extreme cases, cause jamming of the milling tool and the remainder of the milling assembly.

With a view to reducing as far as possible the undesirable birdsnesting effect referred to above, it is recognized to be a desirable characteristic during milling operations for the swarf formed to be in the form of short strands or chips. To promote formation of short strands and chips considerable effort has been expended in designing milling formations which have an inherent tendency to produce short strands or chips of swarf. Additionally, it is recognized that as a general rule the size of swarf produced tends to be reduced as the speed of rotation of the milling tool increases for a given load (weight) on the tool. Thus, with a view to keeping swarf size to a minimum it is recognized that the milling tool should be designed to produce small swarf at an optimum high operating speed and that the tool should be rotated at that high operating speed.

Unfortunately, rotating the top end of a long tubing string at a constant and relatively high speed does not guarantee that a milling tool, which may be located several thousand feet from the rotary table which rotates the tubing, will rotate at a uniform high rotational rate. In particular, variations in the feed rate and characteristics of the casing being milled will produce a variable drag on the milling tool. If, for example, the milling tool is subject to a sudden increase in feed loading or suddenly encounters a discontinuity in the casing material the milling blades may tend to dig in and produce a sudden increase in the resistance of the milling tool to rotation. This will slow the rate of rotation of the milling tool and the continued rotation of the rotary table will thereafter tend to twist the drill string until the resultant increased torque applied to the mill tool enables the tool to overcome the increased resistance. The drill string will then tend to unwind rapidly to relieve the built-up twist resulting in a sudden increase in the rotational speed of the milling tool. The situation is made worse by the fact that the milling tool will, in general, be made up with stabilizers and other components which tend to drag on the casing and will thus contribute to a variable resistance to rotation. The situation is made even worse by the fact that an attempt to rotate the tubing string at a high speed to produce the required high operating speed for the milling tool will increase the frictional drag induced by the engagement of the tubing and the downhole assembly with the casing and thereby further contribute to variations in actual milling tool rotational speed.

Thus, even if a drill string has been rotated at a nominally constant rate by the rotary table of a drilling rig, the rotational speed of a milling tool connected to the string may vary from nothing up to a speed several times faster than the nominal rotational speed of the string. As a result, even if a milling tool is effective to produce small swarf when operating at an optimum speed, the same tool may intermittently produce long swarf in use as a result of the unavoidable variations in actual milling speed.

SUMMARY OF THE INVENTION

According to one aspect of the present invention the above problem is alleviated by incorporating within a downhole assembly which includes a milling tool and is connected to a drill string, a motor which is located adjacent the milling tool and which is effective to rotate the milling tool relative to the drill string in the direction of rotation of the string.

Accordingly, the actual speed of rotation of the milling tool will be equal to the sum of the speed of rotation of the string immediately uphole of the motor, and the speed of rotation of the motor. Because the motor is located relatively close to the milling tool there is very little variation between the speed of rotation of the milling tool and the speed of rotation of the output shaft of the motor—i.e. there is very little facility for the intervening components to absorb relative rotation by torsional displacement. Thus, even if the speed of rotation of the drill string immediately uphole of the motor varies as a result of, for example, varying resistance to rotation of the drill string as the string rotates, the milling tool will be rotated at a speed at least equal to the rotational speed of the motor at all times, and any variation in the speed of rotation of the milling tool due to variations in the speed of rotation of the drill string adjacent the downhole assembly will amount to a relatively small percentage speed variation superimposed on the substantially constant rotation produced by the motor.

Preferably, the motor is a fluid motor which is operated by fluid pumped through the drill string. For example the motor may be a positive displacement mud motor operated by mud pumped through the drill string. The mud, after exiting the motor, is directed to remove and clear swarf from the mill and to carry the swarf up to annulus to the surface for removal and disposal.

A typical downhole assembly for use in an embodiment of the present invention comprises (from bottom to top):

Taper Mill
Stabilizer(s)
Casing Mill
Stabilizer
Crossover
Mud Motor
Stabilizer
Jet Sub
Drill Collar(s)
Drilling Jar
Drill Collar
Crossover
Heavyweight Drill Pipe
Drill Pipe It should be understood, however, that the exact constitution of the downhole assembly may be varied according to the particular requirements of the milling operation.

The jet sub is desirable since it allows for a higher rate of mud flow than the motor can usefully use and assists in the back flow (lift) of cuttings to the surface.

In a typical installation a drilling rig may be utilised to rotate a drill string at a nominal 70 rpm and with a mud flow rate sufficient to operate a downhole mud motor and provide for effective clearing of swarf. Under these circumstances a mud motor forming part of the downhole assembly may have an output shaft which rotates at 235 rpm relative to the body of the motor. Since the body itself will rotate at an average of 70 rpm (the speed of rotation of the rotary table), the total speed of rotation of the output shaft of the motor, and thus the speed of rotation of the milling tool, will average 305 rpm. Although some variation in this speed will occur as a result of varying drag on the drill string as it rotates, the speed of rotation of the milling tool should never be less than the speed of rotation of the motor—i.e. never less than 235 rpm. The rotational speeds quoted should be regarded as only typical for one installation. If desired, higher or lower rotational speeds may be effected by varying the nominal rotational speed of the string or the speed of the motor by appropriate selection of drive components.

Although no shock sub is included in the proposed assembly, such a sub may be included. However, it is believed that the bearing assembly and the design of the motor compensate for the shock sub and behave in a similar fashion.

If a casing being milled is cemented in position, milling of the casing exposes the cement and as milling progresses a column of cement will be left standing above the milling tool. Conventionally, this column of cement is removed periodically to remove the danger that the column may fall on top of the milling assembly and thereby trap the milling assembly in the hole. Usually, the cement is removed by a separate run using a hole opener, bit or other tool.

A particular advantage of the present invention is that an appropriate cement removing tool may be incorporated in the downhole assembly some distance above the mill. For example, an appropriate tool may be located approximately 180 feet above the mill. The noted variations in the rotational speed of the drill string at this point will not adversely affect the operation of a typical cement removing tool. Cement cuttings so removed will be circulated out of the hole with the drilling mud and rate of penetration will not be effected. Accordingly, the need for a separate run to remove the cement liner is removed.

In a particularly preferred embodiment of the present invention the downhole assembly includes a THRUSTER™. This is a hydraulic feed tool which achieves a constant weight on the milling tool and thus gives smooth running and optimum penetration.

BRIEF DESCRIPTION OF THE DRAWING

The invention will be better understood from the following description of a preferred embodiment thereof given by way of example only, reference being had to the accompanying drawing wherein the single FIGURE illustrates schematically a preferred embodiment of a downhole assembly according to the present invention.

DETAILED DESCRIPTION OF THE PREFERRED EMBODIMENT

Referring to the drawing, the illustrated downhole assembly 1 would, in use, be mounted on the bottom of drill string. The drill string would, in use, be rotated in conventional manner for a suitable drilling rig.

The top component of the illustrated assembly is a drilling jar 2 which is connected by one or more collars 3 to a jet sub 4. As explained above, the jet sub 4 allows part of the mud flow through the drill string to be diverted into the annulus surrounding the assembly and thereby assist lift of cuttings and other debris to the surface. The jet sub 4 is connected to an undergauge stabilizer 5 which in turn is connected to a mud motor 6. The mud motor 6 may be of any suitable design and is powered by mud supplies through the drill string from the surface.

The output shaft of the motor 6 is connected by a crossover 7 to a stabilizer 8 which is in turn connected to a casing mill 9. The casing mill 9 is designed to operate at a relatively high rotational speed to disintegrate the casing into chips or short strands. The optimum rotational speed of the casing mill 9 will typically be equal to the sum of the nominal rotation speed of the drill string and the operating speed of the motor 6. It is to be understood, however, that under certain circumstances it may be desirable for the optimum speed of operation of the casing mill 9 to be somewhat different from the sum of the drill string speed and the motor operating speed.

The mill 9 is connected by stabilizers 10 to a taper mill 11 which forms the bottom of the assembly.

With a view to minimising variations in drag on the milling tool 9 produced by variable feed rates the assembly may, if desired, incorporate a hydraulic feed tool which produces a constant weight on the milling tool in use of the assembly.

I claim:

1. Apparatus for milling the casing of a wellbore, the apparatus comprising a drill string extending into the wellbore; means for rotating the drill string in a first rotational direction from a point exterior to the wellbore; and a downhole assembly connected to the drill string; the downhole assembly comprising a motor having a body connected to the drill string and an output shaft which, during operation of the motor, is rotated relative to the body in the said first rotational direction, and a milling tool connected to the output shaft of the motor for milling the casing.

2. Apparatus according to claim 1 including a taper mill located at the distal end of the downhole assembly.

3. Apparatus according to claim 2 comprising at least one stabilizer mounted between the taper mill and the milling tool for engaging the interior of the casing to be milled.

4. Apparatus according to claim 1 including at least one stabilizer located between the milling tool and the motor.

5. Apparatus according to claim 1 including at least one stabilizer located between the motor and the drill string.

6. Apparatus according to claim 1 including at least one jet sub mounted between the motor and the drill string.

7. Apparatus according to claim 1 wherein the downhole assembly includes at least one cement removing tool located above the motor.

8. Apparatus according to claim 1 wherein the motor is a mud motor.

9. Apparatus according to claim 1 wherein the downhole assembly includes means for applying a substantially constant weight on the milling tool.

10. A method of disintegrating a well casing comprising running into the well casing on a drill string a downhole assembly comprising a motor having an output shaft and a milling tool connected to the output shaft of the motor; rotating the drill string in a first rotational direction to rotate the body of the motor and simultaneously operating the motor to rotate the output shaft of the motor in the first rotational direction and thereby rotate the milling tool at a rotational speed faster than the rotational speed of the drill string.

* * * * *